United States Patent [19]

Altwicker

[11] Patent Number: 4,694,984

[45] Date of Patent: Sep. 22, 1987

[54] AUTOMATIC RIVETING PRESS

[75] Inventor: Gerhard H. J. Altwicker, Eschweiler, Fed. Rep. of Germany

[73] Assignee: William Prym-Werke GmbH. & Co. KG, Stolberg, Fed. Rep. of Germany

[21] Appl. No.: 828,833

[22] Filed: Feb. 12, 1986

[30] Foreign Application Priority Data

Mar. 7, 1985 [DE] Fed. Rep. of Germany ..... 3508018

[51] Int. Cl.[4] ..... A41H 37/02

[52] U.S. Cl. ..... 227/18; 227/109; 227/156; 29/243.53

[58] Field of Search ..... 227/1, 2, 115, 114, 227/149, 156, 18, 30, 109, 99; 29/701, 709, 714, 715, 243.53, 703; 83/71, 69; 340/712; 221/13, 12, 112

[56] References Cited

U.S. PATENT DOCUMENTS

| | | | |
|---|---|---|---|
| 1,855,235 | 4/1932 | Havener | 227/18 |
| 3,279,671 | 10/1966 | Bachman, Jr. et al. | 227/1 |
| 3,511,427 | 5/1970 | Cilione | 227/1 |
| 3,610,464 | 10/1971 | Loughry | 221/13 |
| 4,524,414 | 6/1985 | Kiyokawa | 340/712 |
| 4,541,558 | 9/1985 | Herten et al. | 227/1 |
| 4,566,182 | 1/1986 | Altwicker et al. | 227/7 |
| 4,573,261 | 3/1986 | Honda et al. | 29/701 |
| 4,580,475 | 4/1986 | Antonissen | 83/71 |

*Primary Examiner*—E. R. Kazenske
*Assistant Examiner*—James L. Wolfe
*Attorney, Agent, or Firm*—Peter K. Kontler

[57] ABSTRACT

A riveting press for the application of several types of compatible first and second articles of hardware to garments has a discrete magazine for each first and second article, applicators for first and compatible second articles, a foot pedal for initiating a cycle of operation of the applicators, and a computer-operated feeding unit for delivering selected first and complementary second articles from the respective magazines to the corresponding applicators. The computer for the feeding unit can be programmed to select the sequence in which various different first and compatible second articles are fed to the respective applicators, and to select the number of identical first and compatible second articles which are fed during successive cycles of the press. The keyboard of the programming unit for the computer has two discrete sections and has keys for transmission of signals which determine the sequence, keys for transmission of signals which determine the total number of identical articles to be fed during successive cycles, signal displaying elements and counters which indicate the numbers of remaining first and compatible second articles of selected total numbers during each stage of operation of the press in accordance with a selected program.

19 Claims, 2 Drawing Figures

AUTOMATIC RIVETING PRESS

CROSS-REFERENCE TO RELATED CASES

The riveting press of the present invention is similar to that which is disclosed in the commonly owned copending patent application Ser. No. 818,791 filed Jan. 14, 1986 and to riveting presses which are disclosed in numerous other pending applications and patents of the same assignee. Reference may be had U.S. Pat. No. 4,541,558 granted Sept. 17, 1985 and to pending patent applications Ser. Nos. 598,989 filed Apr. 11, 1984; 599,176 filed Apr. 11, 1984; 655,048 filed Sept. 26, 1984 and disclosing articles of the type capable of being treated in the riveting press of the present invention; and 729,616 filed May 2, 1985.

BACKGROUND OF THE INVENTION

The present invention relates to improvements in machines which are utilized for the application of articles of hardware or the like to sheets, panels, strips or like carriers which are made of a textile material or of any other suitable penetrable material and on which the applied articles can be used as component parts of snap fasteners or the like. More particularly, the invention relates to improvements in riveting presses and like machines for the application of articles of hardware to garments or the like.

It is already known to equip a riveting press with a magazine for storage of first articles of hardware, and with a second magazine for storage of second articles of hardware each of which is designed to be assembled with a first article. For example, it is known to apply to one side of each of a series of successive garments male or female components of snap fasteners (such components can be said to constitute two different types of first articles of hardware) by means of corresponding retaining articles in the form of rings with prongs which are caused to penetrate through the garment from the other side and to be thereupon coupled to the corresponding (male and female) component. The system for feeding articles to the applicators (i.e., to devices including the tools which actually affix the articles to the respective sides of garments or the like) is often automated so as to ensure immediate delivery of selected articles to the applicators as soon as a machine cycle is completed.

A drawback of presently known riveting presses is that a first machine must be used to assemble first articles of a first type (e.g., male components of snap fasteners) with first articles of a second type (e.g., rings with several prongs), and that a discrete second press is necessary to assemble different (second) articles of the first type (e.g. female components of snap fasteners) with corresponding second articles of the second type. This means that a garment which is to be provided with male and female components of snap fasteners must be treated in a first riveting press and thereupon in a discrete second riveting press. Such operation is time-consuming and cumbersome, and the initial and maintenance cost of several riveting presses is very high.

OBJECTS AND SUMMARY OF THE INVENTION

An object of the invention is to provide a novel and improved machine for the application of corresponding or compatible first and second articles of hardware or the like to pieces of textile material or to other types of carriers, and to construct the machine in such a way that its versatility greatly exceeds the versatility of heretofore known machines.

Another object of the invention is to provide a universal riveting press which can be utilized for selective assembly of different types of first articles with different types of corresponding second articles in any desired sequence and as often as necessary.

A further object of the invention is to provide a riveting press which is automated to the maximum extent permissible or advisable in order to enable the press to apply pairs of corresponding articles to sheets of textile material or the like.

An additional object of the invention is to provide the above outlined riveting press with novel and improved means for automating the operation of the system for feeding related or compatible pairs of articles of hardware to the respective tools.

Still another object of the invention is to provide the above outlined riveting press with novel and improved means for feeding articles of hardware to the tools which are used to directly apply such articles to garments or to other types of carriers.

An additional object of the invention is to provide the press with novel and improved means for controlling the operation of the article feeding system and with novel and improved means for programming the operation of the controlling means.

A further object of the invention is to provide a machine which can be used as a superior substitute for several conventional riveting presses.

Another object of the invention is to provide a riveting press which can be rapidly converted for operation in accordance with any one of a number of different programs.

An additional object of the invention is to provide the riveting press with novel and improved means for enabling the operator or operators to eliminate the causes of malfunction without erasing the program which has been selected for the application of pairs of compatible articles of hardware or the like to garments or to other types of carriers.

A further object of the invention is to provide a riveting press whose manipulation is relatively simple so that it can be programmed and operated by semiskilled persons.

The invention is embodied in a cyclically operated machine for assembling complementary or compatible first and second articles of hardware or the like, particularly in a riveting press for affixing first and second components of snap fasteners to garments or other types of carriers. The improved machine comprises first and second applicator means, a plurality of first sources for supplies of different types of first articles, a plurality of corresponding second sources for supplies of different types of second articles (each type of second articles is compatible with a particular type of first articles), article feeding means operable to deliver first and compatible second articles from the first and second sources to the first and second applicators, respectively, programmable signal generating control means for operating the feeding means, and means for programming the control means. The programming means preferably includes first signal generating means for determining the sequence in which the feeding means is operated to deliver different types of first and compatible second articles from the respective first and second sources, and second signal generating means for selecting the total number of first and second articles of each type to be delivered seriatim from the selected first and corresponding second sources. By way of example, the first seven cycles of a total of eighteen successive machine cycles can involve the application of female components of snap fasteners and compatible second articles which penetrate through a carrier and are affixed to the female components; the next four cycles can involve the application of male components of snap fasteners and of compatible second articles which secure the male components to the carrier; the next two cycles can involve the application of female components and compatible second articles; and the last five cycles can involve the application of male components and compatible second articles.

The feeding means can comprise discrete first and second conveyors for each of the first and second sources, respectively. The first and second conveyors are respectively activatable to deliver first and second articles from the corresponding first and second sources, and the feeding means further comprises first and second activating means for effecting the delivery of first and compatible second articles by the first and second conveyors in the selected sequence and for maintaining the conveyors in activated condition (or to repeatedly activate the conveyors) so as to effect the delivery of selected total numbers of articles. The construction of the first and second conveyors (e.g., in the form of chutes) can be such that they respectively define first and second paths, and the activating means can comprise mobile gates for selectively permitting and interrupting the delivery of articles along or from the respective paths. For example, the feeding means can comprise two first and two second conveyors, and the gates can include a first gate which is movable between first and second positions in each of which it confines first articles in one of the first paths while permitting first articles to issue from the other of the first paths and a second gate which is movable between first and second positions in each of which it confines second articles in one of the second paths while permitting second articles to issue from the other of the second paths. The activating means preferably further comprises first and second motor means for the first and second gates, respectively. The motor means are responsive to signals from the control means.

Each of the first and second signal generating means can include a plurality of manually operable input elements (e.g., in the form of depressible of heat-sensitive keys) for transmission of signals to the control means. The input elements of the first signal generating means preferably include a plurality of first input elements for transmission of signals which identify the selected sources during each cycle of the machine, and the input elements of the second signal generating means include second input elements for transmission of signals which determine the selected total number of first and compatible second articles of each type which are to be delivered seriatim during successive cycles. The second input elements can include a set of adding and subtracting keys. The programming means can further include means for displaying the signals which are generated by the first and/or second input elements.

The machine further comprise means (e.g., a device including a depressible foot pedal) for actuating the applicator means so as to initiate a machine cycle and hence the assembly of a first article with a compatible second article. The actuating means can further comprise means for transmitting to the control means (and, if necessary, to the programming means) signals to initiate the operation of the feeding means (and to actuate one or more counters of the programming means).

The machine can further comprise means for displaying the remaining number of first and compatible second articles of the total numbers of such articles upon each actuation of the applicator means. Such displaying means can comprise counter means for the first and compatible second articles.

The machine can also comprise a pedal or other suitable operator-controlled means for disconnecting the control means from the feeding means (e.g., to enable the operator to ascertain the cause or causes of a malfunction without erasing the selected program). The operator-controlled means can comprise means for disconnecting the actuating means from the control means simultaneously with disconnection of the control means from the feeding means.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
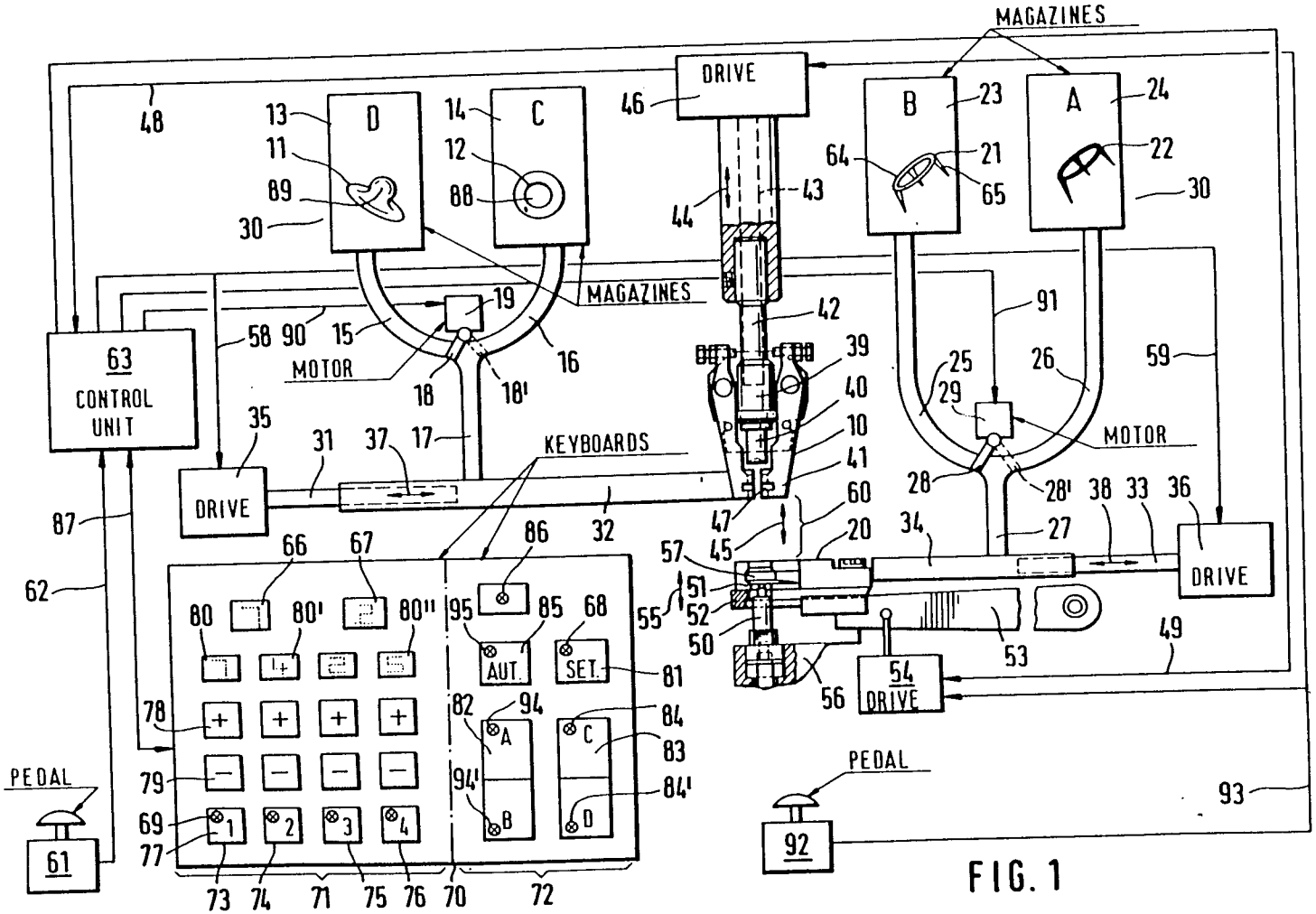
FIG. 1 is a partly diagrammatic elevational view of a riveting press which embodies the invention.
Figure 2:
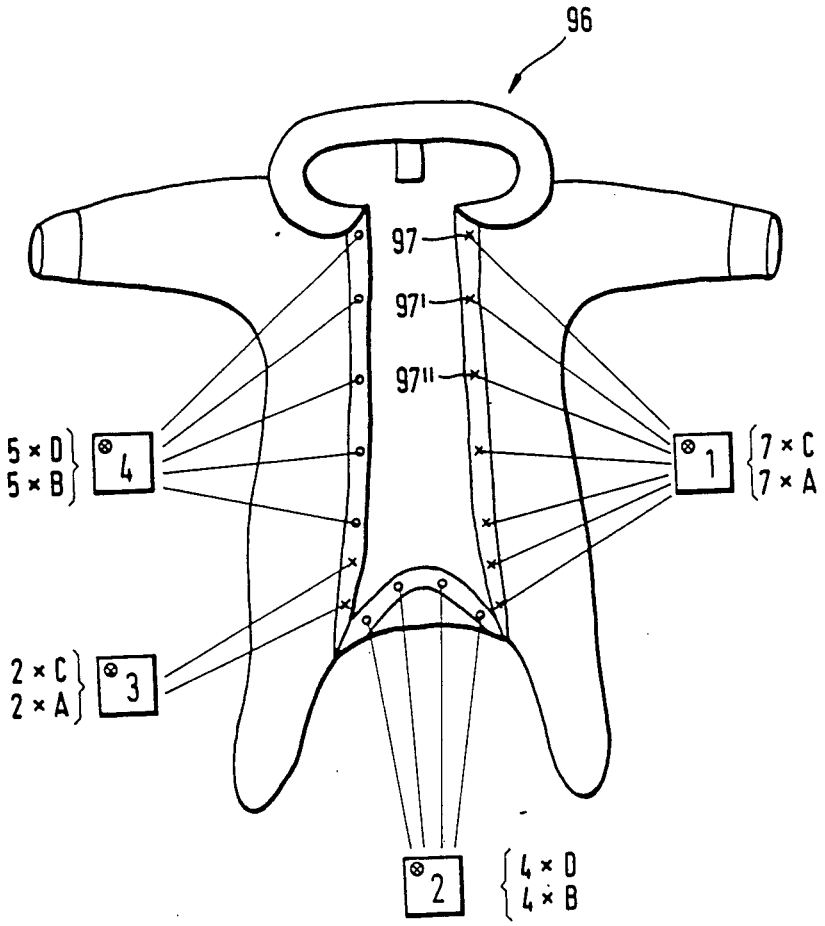
FIG. 2 is a plan view of a garment which is provided, or is about to be provided, with male and female components of snap fasteners.

FIG. 1 shows schematically a riveting press which is used to assemble first articles 11 of a first type with complementary second articles 21 of a first type or to assemble first articles 12 of a different first type with complementary second articles of a different second type. In other words, the articles 11 are compatible with the articles 21, and the articles 12 are compatible with articles 22. The illustrated articles 11 constitute male components of snap fasteners and each thereof has a male detent member 89 having a partly spherical external surface and being capable of penetrating into the female detent member or socket 88 of an article 12 which constitutes the female component of a snap fastener. Each article 21 includes a metallic or plastic ring 64 with several (e.g., three) prongs or teeth 65 extending substantially axially beyond one side of the ring 64. The article 22 is similar to or identical with the article 21 except that it consists of a different material and/or has a different color or hue. The prongs 65 of an article 21 can penetrate from one side and through a piece of textile or other penetrable material (e.g., from one side and through a selected portion of a toddler's or infant's garment 96 which is shown in FIG. 2) to be deformed upon entry into the cavity at the nonillustrated side of the article 11 which is then properly located at the opposite side of the garment whereby the article 11 is reliably affixed to the garment 96. The prongs 65 of an article 22 can penetrate from one side and through a selected portion of the garment 96 to be thereupon deformed into reliable engagement with an article 12 which, at such time, is held in proper position at the other side of the garment.

A supply of articles 11 is held in one first source or magazine 30, a supply of articles 12 is confined in another first source of magazine 14, a supply of articles 21 is confined in one second source or magazine 23, and a supply of articles 22 is maintained in another second source or magazine 24. The articles 22 in the magazine 24 (hereinafter source A) are complementary (i.e., they are capable of being more or less permanently attached) to the articles 12 in the magazine 14 (hereinafter source C), and the articles 21 in the magazine 23 (hereinafter source B) are complementary to (i.e., they are capable of being properly assembled with) the articles 11 in the magazine 13 (hereinafter source D). The letters A, B, C and D (or other suitable indicia) can be actually applied to the respective sources for convenience of the person or persons in charge of servicing and operating the riveting press. In fact, enlarged images of first articles 11, 12 and second articles 21, 22 can be applied to the respective sources in addition to or in lieu of the letters A to D. In the illustrated embodiment, the articles 21 are assumed to be coated with nickel whereas the articles 22 are assumed to be red (or of any other color or hue which can be readily distinguished from the color of nickel).

The illustrated first (11, 12) and second (21, 22) articles can be replaced with different articles of hardware without departing from the spirit of the invention. For example, each of the articles 21, 22 can constitute a rivet having a head (replacing the ring 64) and a shank (replacing the prongs 65) whose free end is deformable in response to penetration into the corresponding article 11 or 12 to thus ensure that the article 11 or 12 is properly secured to the garment 96 of FIG. 2 or to any other selected penetrable carrier. Furthermore, the source A or B can contain multicolored articles or articles of different sizes and shapes. All that counts is to ensure that the riveting press is equipped with at least two first sources (including C and D), with an equal number of second sources (including A and B) and that the articles in each first source are complementary to articles in a particular second source. Articles of hardware which can be applied in the riveting press of the present invention are disclosed, for example, in the aforementioned commonly owned patent application Ser. No. 655,048 filed Sept. 26, 1984 and in the aforementioned commonly owned copending patent application Ser. No. 729,616 filed Mav 2, 1985.

The riveting press of FIG. 1 comprises a first applicator 10 and a second applicator 20 which latter cooperates with the applicator 10 during each cycle of the press to assemble an article 11 or 12 with a complementary or compatible article 21.or 22, depending upon whether the applicators 10, 20 respectively receive articles from the sources C and A or from the sources B and D.

The applicator 10 comprises tongs 41 including two jaws which are pivotable toward and away from each other and have recesses or sockets 47 for reception of portions of and for proper orientation of an article 11 or 12. The directions in which the tongs 41 are movable up and down toward and away from the lower applicator 20 are indicated by a double-headed arrow 45. The applicator 10 further comprises a ram 40 which is disposed between the jaws of the tongs 41 and is movable up and down (with as well as relative to the tongs) in directions which are indicated by a double-headed arrow 44. The tongs 41 are suspended on a reciprocating member 42, and the ram 40 is suspended on a reciprocating member 43 (indicated by broken lines partly behind the member 42). The means for moving the members 42, 43 up and down jointly as well as relative to each other comprises a drive 46. The ram 40 has an enlarged portion or boss 39 which can spread apart the jaws at the lower end of the tongs 41 during a predetermined stage of each cycle of the riveting press so that the article 11 or 12 which was partially confined in the two sockets 47 is released and can be shifted with the garment 96 so as to place another portion of the garment between the applicators 10 and 20. The amplitude of reciprocatory movement of the tongs 41 in the directions of arrow 45 need not match the amplitude of reciprocatory movement of the ram 40 in the directions of arrow 44. The jaws of the tongs 41 are biased toward each other by one or more springs so that they tend to grip an article 11 or 12 in the space below the ram 40.

In FIG. 1, the upper applicator 10 is held in its upper end position, the same as the lower applicator 20 which includes a ram 50 and tongs 51 having two jaws (only one shown) provided with sockets or recesses 57 for reception of portions of and for proper orientation of articles 21 or 22. The jaws of the tongs 51 are disposed above a platform 52 which is mounted on an elongated arm 53 pivotable in the frame 56 about a horizontal axis which extends at right angles to the plane of FIG. 1. The ram 50 is axially adjustably affixed to the frame 56. The drive means 54 for pivoting the arm 53 and for thereby lifting and lowering the platform 52 and the tongs 51 relative to the ram 50 can comprise a fluid-operated motor whose piston rod is articulately connected to an intermediate portion of the arm 53. The directions in which the arm 53 is pivoted by the drive means 54 are indicated by a double-headed arrow 55. The ram 50 registers with the ram 40 and is positioned to effect deformation of an article 21 or 22 during each cycle of the riveting press.

The exact construction of the applicators 10, 20 and of their drives 46, 54 is or can be identical with the construction of such parts in the machine which is disclosed in the aforementioned commonly owned copending patent application Ser. No. 818, 791 filed Jan. 14, 1986. The disclosure of this copending application, as well as of the aforementioned patent and other patent applications, is incorporated herein by reference. Therefore, all details of such applicators are not specifically shown in FIG. 1.

The means 30 for feeding articles 11 or 12 to the sockets 47 of the tongs 40 and for feeding articles 21 or 22 to the sockets 57 of the tongs 51 comprises a discrete conveyor (15, 16, 25, 26) for each of the four sources D, C, B and A. Each of these sources comprises means for admitting the respective articles into the associated conveyor in a predetermined orientation so as to ensure that the orientation of each of a shorter or longer series of successive articles issuing from the source D or C and advancing to the applicator 10 is always the same, and this also applies for the orientation of articles which are supplied by the source B or A and are advanced toward the applicator 20. The manner in which the articles 11, 12 and 21, 22 are oriented on their way from the respective sources is well known, not only from the art of feeding articles of hardware in riveting presses but also from other arts, such as feeding crown corks in bottle capping machines, discharging randomly distributed cassettes for photographic film from hoppers, and many others. All that counts is to ensure that the orientation of each article 11 or 12 in the sockets 47 and the orientation of each article 21 or 22 in the sockets 57 is proper for assembly of articles 11 with the articles 21 or for assembly of articles 12 with the articles 22.

The conveyors 15, 16 and 25, 26 can constitute or include chutes defining vertical or downwardly sloping paths for gravitational discent of rows of properly orientated articles 11, 12 and 21, 22 into the intake ends of common third conveyors 17 and 27, respectively. The conveyors 15 and 25 or 16 or 26 are idle, and such pairs of (corresponding) first and second conveyors can be activated by two mobile (pivotable) gates 18, 28 which are mounted at the junctions of the conveyors 15–17 and 25–27, respectively. The gate 18 is movable between the solid-line position of FIG. 1 in which it interrupts the flow of articles 11 from the path which is defined by the conveyor 15 into the path which is defined by the conveyor 17 but permits articles 12 to advance from the conveyor 16 into or onto the conveyor 17, and the broken-line position 18' in which it interrupts the advancement of articles 12 from the conveyor 16 into or onto the conveyor 17 but permits articles 11 to slide or otherwise advance from the conveyor 15 into or onto the conveyor 17. The means for pivoting the gate 18 between the two positions includes a motor 19 which is started in response to signals from the corresponding output of a programmable control unit 63. A similar or analogous motor 29 is provided to pivot the gate 28 between the solid-line position (transfer of articles 21 from the conveyor 25 into or onto the third conveyor 27 is interrupted but the articles 22 are free to advance from 26 into or onto 27) and the broken-line position 28' of FIG. 1 (transfer of articles 22 is interrupted but the articles 21 are free to reach the conveyor 27).

The feeding means 30 further comprises means for transferring successive articles 11 or 12 from the discharge end of the third conveyor 17 into the sockets 47 of the tongs 41 (when the tongs are maintained at the level which is shown in FIG. 1), and such transferring means comprises an elongated guide 32 for a pusher 31 which is reciprocable by a drive 35 in response to signals from the corresponding output of the control unit 63. The directions in which the pusher 31 is reciprocable relative to the guide 32 are indicated by a double-headed arrow 37. When the pusher 31 is caused to perform a forward stroke, the article 11 or 12 in the guide 32 (at the discharge end of the third conveyor 17) is caused to advance in a direction to the right and to enter the sockets 47 or to compel the foremost article 11 or 12 of a file of such articles in the guide 32 to enter the sockets 47. The pusher 31 is shown in its retracted position, i.e., its front end portion (indicated by broken lines) is located behind the discharge end of the third conveyor 17 so that the latter can admit one or more articles 11 or 12 into the adjacent portion of the guide 32.

The means for transferring articles 21 or 22 from the discharge end of the third conveyor 27 into the sockets 57 of the tongs 51 are analogous to the just described transferring means. FIG. 1 shows the guide 34, the pusher 33 (which is reciprocable in directions indicated by a double-headed arrow 38), and the drive 36 which can reciprocate the pusher 33 and receives signals from the corresponding output of the control unit 63. The discharge end of the guide 34 can admit an article 21 or 22 into the sockets 57 when the arm 53 for the platform 52 and tongs 51 is held in the angular position of FIG. 1.

In FIG. 1, the tongs 41 and 51 are turned through 90 degrees with reference to their actual positions in order to show the two sockets 47 and one of the sockets 57. In other words, the guides 32, 34 extend at right angles to the plane of FIG. 1 or, alternatively, the jaws of the tongs 41 and 51 are located behind and in front of such plane.

The clearance or gap 60 between the applicators 10, 20 in the upper end positions of the tongs 41 and 51 is sufficiently wide to allow for convenient manipulation of the garment 96 so as to cause a selected portion of the textile and/or other material of such garment to overlie the tongs 51 in register with the rams 40 and 50. Once a selected portion of the garment is properly located between the rams 40 and 50, the operator depresses an actuating device 92 (here shown as a foot pedal) in order to initiate a machine cycle by transmitting a signal via conductor 93 to the drives 46, 54 of the applicators 10, 20. Activation of the drive 46 entails the transmission of a signal (via conductor 48) to the corresponding input of the control unit 63. The control unit 63 memorizes that the pedal 92 has been depressed and that the press has completed a cycle, i.e., that an article 11 was attached to the prongs 65 of an article 21 as well as to a selected portion of the garment 96, or that the prongs of an article 22 have been caused to penetrate through a selected portion of the garment 96 and to engage with and be deformed by an article 12. When the cycle is completed and the tongs 41, 51 of the applicators 10, 20 have reassumed their illustrated positions, the control unit 63 transmits signals to the drives 35, 36 (note the conductors 58, 59) so that the pushers 31, 33 perform forward and return strokes with the result that the sockets 47 receive a fresh article 11 or 12 and the sockets 57 receive a fresh article 21 or 22. As mentioned above, the strokes of the pushers 31, 33 can be selected in such a way that they advance articles from the discharge ends of the respective third conveyors 17, 27 all the way into the corresponding sockets 47, 57 or that they cause the foremost articles of files of articles to advance from the discharge ends of the guides 32, 34 into the sockets of the respective tongs.

A cycle of the illustrated riveting press involves the following operations and movements:

When the pedal 92 is depressed, the drive 46 causes the reciprocating member 42 to advance the tongs 41 toward the ram 50 faster than the advancement of the ram 40 with the reciprocating member 43 so that the sockets 47 of the tongs 41 descend with reference to the ram 40. The descending ram 40 catches up with the jaws of the tongs 41 during the last stage of downward movement of the reciprocating members 42 and 43 whereby the boss 39 engages and spreads the jaws of the tongs 41 apart so that the article 11 or 12 is free to leave the sockets 47. The ram 40 pushes the article 11 or 12 against the upper side of the garment 96 which overlies the lower ram 50.

The drive 54 causes the platform 52 and the tongs 51 to descend (by pivoting the arm 53 in a counterclockwise direction) out of phase with the movements of the tongs 41 and ram 40. The article 21 or 22 in the sockets 57 of the tongs 51 shares such downward movement of the platform 52. The stationary ram 50 intercepts the descending article 21 or 22 and causes its prongs 65 to penetrate through the adjacent portion of the garment 96 on the platform 51. The article 11 or 12 at the upper side of such portion of the garment moves downwardly toward and into engagement with the tips of the prongs 65 with attendant deformation of the prongs and resulting coupling of the article 11 or 12 to the article 21 or 22. The drives 46 and 54 thereupon cause the applicators 10 and 20 to reassume the illustrated starting (upper end) positions and to thus complete the cycle.

The means 70 for programming the control unit 63 comprises two sections in the form of keyboards 71 and 72 with input elements in the form of depressible or otherwise movable keys which can be actuated by the operator to transmit signals to the memory of the control unit 63. The programming means 70 has a first signal generating unit which is designed to transmit signals serving to determine the sequence in which the feeding means 30 (including the conveyors 15–17, 25–27, gates 18, 28, motors 19, 29, pushers 31, 33, guides 32, 34 and drives 35, 36) is operated to deliver different types of first and complementary second articles (e.g., articles 11 and 21 or 12 and 22) from the respective first (D, C) and second (B, A) sources, and a second signal generating unit which transmits to the control unit 63 signals serving to determine the total number of first and second articles of each type to be delivered seriatim from the selected first (D or C) and second (B or A) sources. FIG. 1. shows, merely by way of example, the following program: A total number of seven articles 12 and a total number of seven articles 22 are delivered to the applicators 10, 20 during the intervals preceding seven consecutive cycles of the machine; the next four cycles involve the application of four articles 11 and four articles 21; the next two cycles involve the application of two articles 12 and two articles 22; and the next five cycles involve the application of five articles 11 and five articles 21. This concludes the application of a total of nine complete snap fasteners (11+12) to the garment 96, and the press is then ready to apply the same number of fasteners to a next-following garment 96 unless the program which is memorized by the control unit 63 is altered by the operator or the operator decides to interrupt the transmission of signals from the control unit 63 to the feeding means 30.

The illustrated programming means 70 is designed for transmission of signals which involve a program of the just outlined complexity, i.e., the program has a maximum of four stages each of which involves the application of one or more pairs of articles 11, 21 or 12, 22 and each stage can embrace one or more cycles. In other words, the control unit 63 can be caused to automatically operate the feeding means 30 in such a way that the application of articles 11, 21 (or 12, 22) is followed by the application of articles 12, 22 (or 11, 21), thereupon by the application of articles 11, 21 (or 12, 22) and finally by the application of articles 12, 22 (or 11, 21).

The keyboard 71 is provided with four rows 73, 74, 75, 76 of three keys 77, 78, 79 each, and the keyboard 72 has two keys 82, 83. The keys 82, 83 are those input elements (of the first signal generating unit) which determine the sequence in which pairs of articles 11, 21 or 12, 22 are applied to a garment 96, and the keys 77–79 are input elements (of the second signal generating unit) which determine the total number of pairs of articles (11, 12 or 12, 22) which are applied during a stage of the program.

The number of rows (73–76) determines the maximum number of stages in a program. However, each row of keys could be used to select two or more stages of a given program. For example, the keys of the four rows 73–76 can be depressed during several successive passes to thus increase the maximum number of stages of a program to a multiple of four.

Each of the rows 73–76 comprises a depressible or otherwise movable or activatable input element or key 77 which generates signals denoting the ordinal number of a particular stage of a program. A second input element 78 is an adding key, and a third input element 79 is a subtracting key. A signal displaying window 80 is provided on the keyboard 71 for each of the four rows 73–76 to indicate the total number of signals which have been selected for transmission to the control unit 63 by the respective row. The numeral "7" in the leftmost displaying window 80 of the keyboard 71 denotes that the keys 77–79 of the row 73 have been actuated to select the delivery of a total number of seven articles 12 to the applicator 10 and a total number of seven articles 22 to the applicator 20 for (the first) seven cycles of the riveting press. The window 80′ displays the numeral "4" which denotes that, during the next stage of a complete program, the press will apply four articles 11 and four articles 21 during four successive (eighth to eleventh) machine cycles. The window to the right of the window 80′ displays the numeral "2" denoting that the third stage of a program involves the application of two articles 12 and two articles 22 during two consecutive (twelfth and thirteenth) cycles of the press. The window 80″ exhibits the numeral "5" denoting that the last stage of a program involves the application of five articles 12 and five articles 22 during five consecutive (fourteenth to eighteenth) cycles of the machine. The number (nine) of attached two-piece snap fasteners (11+12) which are applied while the control unit 63 operates the feeding means 30 in accordance with a selected program is half the number (eighteen) of cycles.

The input elements or keys 82, 83 of the keyboard 72 are actuatable to transmit signals serving to determine the sequence in which the articles 11, 21 and 12, 22 are applied to the garment 96 while the machine completes a selected number of cycles. Thus, the keys 82 and 83 determine whether the first cycle or cycles involve the application of pairs of articles 11, 21 or the application of pairs of articles 12, 22, whether the next-following cycle or cycles involve the application of pairs of articles 12, 22 or the application of pairs of articles 11, 21, and so forth. The key 82 can select the articles 21 or 22 and the key 83 can select the articles 11 or 12. The arrangement is such that a first depression of the key 82 entails a completion of the circuit of a light-emitting diode 94 and renewed depression of the same key 82 results in completion of the circuit of a second light-emitting diode 94′. Analogously, a first diode 84 emits light in response to a first depression of the key 83, and renewed depression of this key entails a completion of the circuit of a second light-emitting diode 84′. The row-identifying keys 77 of the rows 73–76 are provided with light-emitting diodes 69 which indicate the corresponding stages of a programming operation.

When the diode 94 emits light, the operator knows that the keyboard 72 transmits to the control unit 63 a signal denoting that the feeding means 30 is to be operated to permit the transfer of articles 22 from the source A. Depression of the key 82 entails an opening of the circuit of the diode 94 and causes the diode 94′ to emit light so that the operator knows that the control unit 63 is being programmed to effect the delivery of articles 21 from the source B to the applicator 10. The same applies for the diodes 84 and 84' which are controlled by the key 83, i.e., the diode 84 emits light when the memory of the control unit 63 receives signals for effecting the transfer of articles 12 from the source C, and the diode 84' lights up when the memory of the control unit 63 is to store signals which effect the transfer of articles 11 from the source D.

A complete programming operation (to store a program which enables the riveting press to apply nine complete snap fasteners 11+12, e.g., in the distribution which is shown in FIG. 2) is carried out as follows:

The operator is instructed or selects to apply the components of the snap fasteners in the following sequence: The application of seven articles 12 (each having a socket 88) and hence of seven articles 22 is to be followed by the application of five articles 11 (with male detent members 89) and five articles 21. The next-following two cycles entail the application of two articles 12 and an equal number of articles 22, and the last five cycles involve the application of five articles 11 and five articles 21. In FIG. 2, the locations for the application of articles 12 are denoted by the symbols "x" and the locations for the application of articles 11 are denoted by the symbols "o". The manner in which the male detent members 89 of the properly affixed articles 11 can be snapped into the sockets 88 of the properly affixed articles 12 in order to confine an infant or a toddler in the garment 96 is self-evident.

The first step of a programming operation involves the closing of a master switch (not shown) to connect the riveting press and the programming means 70 with a suitable source of electrical energy. Closing of such master switch is indicated by a signal lamp 86 on the keyboard 72. The person in charge then depresses a key 81 so that the associated diode 68 emits light while the signal lamp 86 is turned off. The operator thereupon depresses the key 77 of the row 73 to complete the circuit of the associated diode 69 and to thus indicate that the programming means 70 is ready to transmit to the control unit 63 a first signal denoting the total number (seven) of pairs of articles 12 and 22 which are to be fed to the applicators 10, 20 preparatory to first seven depressions of the pedal 92. If necessary, the operator then depresses the key 82 so as to complete the circuit of the diode 94 which indicates that a depression of the key 78 or 79 in the row 73 will entail the selection of a desired total number of articles 22 which will be fed from the source A. If necessary, the operator also depresses the key 83 so as to ensure that the diode 84 emits light, i.e., that the feeding of articles 22 from the source A will take place simultaneously with the feeding of articles 12 from the source C. The key 82 and/or 83 must be depressed only if the diode 94 and/or 84 does not emit light in immediate response to closing of the master switch (signal lamp 86) and/or subsequent depression of the key 81.

The operator thereupon depresses the key 78 or 79 of the row 73 on the keyboard 71 until the left-hand window 80 displays the desired total number (seven) of pairs of articles 12, 22. If the left-hand window 80 displays the numeral "0", the operator depresses the adding key 78 of the row 73 seven successive times. If the leftmost window 80 initially displays a numeral (e.g., nine) which is higher than the desired total number of pairs of articles 12, 22, the operator depresses (once or more than once) the subtracting key 79 of the row 73.

The next stage of the programming operation involves a depression of the knob 77 in the row 74 to activate the corresponding diode 69 and to open the circuit of the diode 69 in the row 73. The operator then depresses the knobs 82 and 83 (to complete the circuits of the diodes 94' and 84') so that the memory of the control unit 63 is ready to receive a signal which denotes the total number (four) of pairs of articles 21 and 11 which are to be delivered from the respective sources B and D during the second stage of a program. The total number of such pairs is selected by the key 78 or 79 of the row 74, and such selected number is displayed by the window 80'.

The third stage of the programming operation involves a depression of the key 77 in the row 75 to activate the corresponding diode 69 (while the circuit of the diode 69 on the key 77 of the row 74 is erased), a depression of the keys 82 and 83 to select the sources A and C, and a depression of the key 78 or 79 in the row 75 to select the total number (two) of pairs of articles 12 and 22. Such total number is displayed in the window 80 of the row 75.

The final stage of the programming operation involves a depression of the key 77 in the row 76, a depression of the keys 82 and 83 (to select the sources B and D), and a depression of the key 78 or 79 in the row 76 until the window 80" displays the selected total number (five). The means for transmitting signals from the programming means 70 to the control unit 63 includes conductors 87.

When the programming operation is completed, the operator depresses the key 81 to turn off the diode 68 and to turn on a counter 66 whose window displays the total number of pairs of articles (12, 22) which are to be applied during the first seven cycles of the machine. In the next step, the operator depresses a working key 85 of the keyboard 72 to activate a diode 95 which indicates that the automatic counter system of the control unit 63 is ready for operation. Furthermore, a depression of the knob 85 entails a renewed completion of the circuit of the signal lamp 86.

Prior to the application of a first pair of articles 12 and 22, the operator of the riveting press must ensure that a proper article (12) is held in the sockets 47 and that a proper article (22) is held in the sockets 57 of the respective applicators 10, 20 before the foot pedal 92 is depressed to activate the applicators and to thus start the first cycle of the selected program. The operator of the press can see the articles which are actually received in the sockets 47 and 57; if the articles are not those which should be applied to a garment 96 in the first step, the operator depresses a pedal 61 which actuates a switch serving to disconnect the control unit 63 from the feeding means 30 (i.e., from the motors 19, 29 and drives 35, 36) and to further disconnect the pedal 92 from the control unit 63 (the connection between the control unit 63 and the pedal 92 is normally established by way of the conductor 93, drive 46 and conductor 48). Depression of the pedal 61 renders it possible to activate the applicators 10, 20 (in response to depression of the pedal 92) independently of the program which is stored in the memory of the control unit 63. Disconnection of the control unit 63 from the feeding means 30 in response to depression of the pedal 61 is signalled by the lamp 86 whose diode is turned off. The operator then depresses the pedal 92 as often as is necessary in order to expel the "wrong" articles (11, 21) from the sockets 47 and 57. Such activation of the applicators 10, 20 is terminated when the operator notices that the sockets 47 confine an article 12 and that the sockets 57 confine an article 22. The machine is then ready for operation in accordance with the selected program in response to renewed depression of the pedal 61 which activates the signal lamp 86 to indicate that the operative connection between the control unit 63 on the one hand and the pedal 92 and feeding means 30 on the other hand has been reestablished.

The operator thereupon places a selected portion 97 of the garment 96 into the gap 60 between the rams 40 and 50 before the pedal 92 is depressed to initiate the first cycle of first stage of the selected program. At such time, the control unit 63 ensures that the gates 18 and 28 of the feeding means 30 are maintained in the solid-line positions of FIG. 1, i.e., that the articles 11 cannot enter the conveyor 17 and the articles 21 cannot enter the conveyor 27. The motors 19, 29 for the gates 18, 28 are connected to the corresponding outputs of the control unit 63 by conductors 90 and 91. The press comes to a halt as soon as the first cycle is completed, i.e., the start of the next cycle must be initiated by a renewed depression of the pedal 92. This enables the operator to change the position of the garment 96 with reference to the applicators 10, 20 so as to place a different portion 97' into register with the rams 40 and 50. The keyboard 71 is operatively connected with the pedal 92, with the drive 46 or with the drive 54 so as to actuate the counter 66 in response to each depression of the pedal 92 when the press is operated in accordance with the selected program. Thus, the window of the counter 66 displays the numeral "6" upon completion of the first cycle, the numeral "5" upon completion of the second cycle, and so forth. The numerals which are displayed by the windows 80 in the rows 73–76 remain unchanged because they indicate the total numbers of pairs of articles 11, 21 or 12, 22 which are to be applied during the corresponding stages of operation in accordance with a complete program. The control unit 63 transmits signals (via conductors 58, 59) upon completion of each cycle to activate the two transferring means of the feeding means 30 and to thus ensure that fresh articles 12, 22 are introduced into the respective sockets 47, 57 prior to renewed depression of the pedal 92.

The application of the second pair of corresponding articles 12, 22 is followed by a renewed shifting of the garment 96 to place a portion 97'' between the rams 40, 50 before the pedal 92 is depressed to start the third cycle of the first stage. The same procedure is repeated a total of seven times until the window of the counter 66 displays the numeral "0". The conductors 90 and 91 then transmit signals which cause the motors 19, 20 to move the respective gates 18 and 28 to the broken-line positions 18', 28' so that the sockets 47 and 57 are ready to respectively receive articles 11 and 21. The operator has placed the selected portion of the garment between the rams 40, 50 before the pedal 92 is depressed again to start the first cycle of the second stage of operation in accordance with the selected program. The gates 18, 28 are returned to the solid-line positions of FIG. 1 upon completion of four successive cycles, and the operator then actuates the applicators 10, 20 twice in order to apply two pairs of articles 12, 22 before the control unit 63 returns the gates 18, 28 to the positions 18' and 28' in order to enable the machine to complete the last five cycles each of which involves the application of a pair of articles 11 and 21. The operation with the selected program is now completed and the control unit 63 is ready to operate the feeding means 30 in accordance with the same program in response to renewed depressions of the pedal 92. Such renewed depression is preceded by the placing of the portion 97 of a fresh garment 96 between the rams 40, 50 of the applicators 10, 20.

If the operation in accordance with the selected program must be interrupted for any one of a number of reasons, e.g., because the applicators 10, 20 have failed to properly secure the articles 11 and/or 12 to a garment or to another carrier, the operator depresses the pedal 61 in order to disconnect the control unit 63 from the feeding means 30 and pedal 92. The signal lamp 86 is turned off to denote that the connection between the control unit 63 and the means 30 and pedal 92 is interrupted, and this informs the operator that she or he can attend to elimination of the defect, e.g., by depressing the pedal 92 (once or more than once) in order to ascertain the cause of malfunction and/or to ascertain whether or not the cause of malfunction has been eliminated. Such depression or depressions of the pedal 92 do not affect the counter 66 which changes the displayed numeral only when the press is operated in accordance with a selected program. When the cause of malfunction is eliminated and a proper portion of the garment is located between the rams 40, 50 (the operator can ascertain this by looking at the numeral which is displayed in the window of the counter 66), the pedal 61 is depressed again to reestablish the connection between the control unit 63 on the one hand and the feeding means 30 and the pedal 92 on the other hand. The operative connection between the pedal 61 and the corresponding input of the control unit 63 includes one or more conductors 62.

It goes without saying that the improved press can be designed to apply three or more pairs of different first and second articles to garments 96 or to other suitable carriers of articles of hardware. The number of sources in the feeding means is then increased accordingly and the feeding means is provided with a requisite number of actuating means (gates and motors or the like) to ensure that the signals from the control unit 63 can initiate the transfer of selected pairs of articles to the applicators 10 and 20, respectively.

If the number of pairs of corresponding first and second articles which are to be applied to garments of a certain type deviates from the number (18) of pairs of articles on the garment 96, the programming operation is altered accordingly so that, when the programming operation is completed, the windows 80 of the rows 73–76 display different numerals. The keys 82, 83 are also actuated to select the types of articles which are to be applied to garments in accordance with a selected program.

If a program is to comprise fewer than four stages, e.g., if the program involves three stages, one of the four keys 79 (preferably the key 79 in the row 76) is depressed as often as necessary to ensure that the corresponding window (80'') displays the numeral "0".

Each of the motors 19, 29 can comprise an electromagnet which pivots the respective gate 18, 28 to the one or the other position.

The construction of the drive 46 can be similar to or identical with that which is disclosed in the aforementioned copending application Ser. No. 818,791 filed Jan. 14, 1986. The same applies for the drive 54 which preferably derives motion from the drive 46.

Each of the drives 35, 36 can receive motion from the drive 46, the same as the aforementioned drive 54, e.g., through a system of eccentrics, cranks, levers and links as disclosed in Ser. No. 818,791 of Jan. 14, 1986 for the connection between the drives 46 and 54.

The control unit 63 can constitute a commercially available computer (e.g., a microprocessor) and it can be mechanically, pneumatically, hydraulically and/or electrically connected with the drive 46. For example, one or more movable parts of the control unit 63 can receive motion from the drive 46 by way of cams, cranks, eccentrics, links and levers. Thus, the motor which drives the rotary, reciprocatory and/or otherwise movable parts of the drive 46 can also serve to transmit motion to mobile parts of the drives 35, 36 and 54 as well as to the mobile part or parts of the control unit 63. This ensures proper synchronization of all drives, motors and like components.

An important advantage of the programming means 70 is that its subdivision into two discrete or easily distinguishable sections or keyboards 71, 72 facilitates the task of the programmer and thus allows for rapid and convenient selection of any one of a number of different programs. The keys 78, 79 of the section 71 determine the total number of pairs of articles 11, 21 or 12, 22 which are to be applied during successive cycles, and the keys 82, 83 of the section 72 enable the programmer to select the pairs of articles which are to be assembled with each other and which are to be simultaneously applied to a garment 96 or the like during a particular stage of a selected program. Moreover, the section 71 enables the programmer or the operator of the press to rapidly ascertain the exact stage of operation of the press in accordance with the selected program because the windows 80 display the remaining number of cycles in a particular stage of the selected program. The changeover from one program to a different program is simple and can be completed rapidly so that the press can be put to renewed use with little loss in time between the treatments of garments which must be provided with different numbers of pairs of compatible articles.

The illustrated press is relatively simple because it comprises only one pair of sources (C, D) of first articles and only one pair of sources (A, B) of Rsecond articles. Such presses can be used with particular advantages for the application of male and female components of snap fasteners to garments or the like. The feeding means 30 of the illustrated press is also simple because its transferring units merely comprise two gates 18, 28 and an equal number of motors (19, 29). The utilization of such relatively simple feeding means renders it possible to employ a simple and inexpensive control unit.

The complexity of the programming means 70 can be selected practically at will. Thus, the number of keys and/or other types of input elements on the keyboard 71 and/or 72 can be increased or reduced depending on the complexity of the control unit 63 and of the feeding means 30. The windows 80 are optional but desirable and advantageous, not only during programming but also when the press is in actual use. The same applies for the counter 66.

The dimensions of the programming means 70 in proportion to the dimensions of the feeding means 30 and applicators 10, 20 are greatly exaggerated in FIG. 1 for the sake of clarity.

The window of the counter 66 displays the number of remaining cycles during the first and second stages (rows 73 and 74). The counter 67 performs the same function in connection with the number of remaining cycles during the third and fourth stages (rows 75 and 76). The counters 66 and 67 receive signals from the pedal 92 by way of the conductor 93, drive 46, conductor 48, control unit 63 and conductor 87.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A cyclically operated machine for assembling complementary first and second articles of hardware at a single assembling station, particularly a riveting press for affixing first and second components of fasteners to garments and the like, comprising first and second applicatior means at said single station; a plurality of first sources for supplies of different types of first articles; a plurality of corresponding second sources for supplies of different types of second articles, each type of second articles being complementary to a particular type of first articles; article feeding means operable to deliver first and complementary second articles from said first and second sources to said first and second applicator means, respectively, comprising discrete first and second conveyors for each of said first and second sources, respectively, said first and second conveyors being respectively activatable to deliver first and second articles from the corresponding first and second sources; programmable signal transmitting control means for operating said feeding means so as to select, prior to each cycle, a discrete first and a discrete second conveyor for delivery of respective articles to the corresponding applicator means; and means for programming said control means, including first signal generating means for determining the sequence in which said feeding means is operated to deliver different types of first and complementary second articles from the respectively first and second sources, and second signal generating means for selecting the total number of first and second articles of each type to be delivered seriatim from the selected first and corresponding second sources.

2. The machine of claim 1, wherein said feeding means further comprises first and second activating means for effecting the delivery of first and complementary second articles by said first and second conveyors in said sequence and for maintaining the conveyors in activated condition so as to effect the delivery of selected total numbers of articles.

3. The machine of claim 2, wherein said first and second conveyors respectively define first and second paths and said activating means comprise mobile gates for selectively permitting and interrupting the delivery of articles along the respective paths.

4. The machine of claim 3, wherein said feeding means comprises two first and two second conveyors, said gates including a first gate movable between first and second positions in each of which it confines first articles in one of said first paths while permitting first articles to issue from the other of said first paths, and a second gate movable between first and second positions in each of which it confines second articles in one of said second paths while permitting second articles to issue from the other of said second paths.

5. The machine of claim 4, wherein said activating means further comprises first and second motor means for said first and second gates, respectively, said motor means being responsive to signals from said control means.

6. The machine of claim 3, wherein said first and second conveyors respectively further comprise first and second motorized means for advancing first and second articles from the respective gates to the first and second applicator means.

7. The machine of claim 1, wherein each of said signal generating means includes a plurality of manually operable input elements for transmission of signals to said control means.

8. The machine of claim 7, wherein the input elements of said first signal generating means include a plurality of first input elements for transmission of signals which identify the selected sources during each cycle of the machine, the input elements of said second signal generating means including second input elements for transmission of signals which determine the selected total number of first and corresponding second articles of each type which are to be delivered seriatim during successive cycles.

9. The machine of claim 8, wherein said second input elements include a set of adding and subtracting keys.

10. The machine of claim 8, further comprising means for displaying the signals which are generated by said second input elements.

11. The machine of claim 10, wherein said displaying means comprises a plurality of discrete signal displaying devices.

12. The machine of claim 1, further comprising means for actuating said applicator means so as to initiate a machine cycle and the assembly of a first article with a corresponding second article.

13. The machine of claim 12, wherein said actuating means comprises a pedal.

14. The machine of claim 12, wherein said actuating means includes means for transmitting to said control means signals to initiate the operation of said feeding means.

15. The machine of claim 12, further comprising means for displaying the remaining number of first and corresponding second articles of said total numbers upon each actuation of said applicator means.

16. The machine of claim 15, wherein said displaying means comprises counter means for first and second articles.

17. The machine of claim 12, further comprising operator-controlled means for disconnecting said control means from said feeding means.

18. The machine of claim 17, wherein said actuating means includes means for transmitting to said control means signals to initiate the operation of said feeding means, said operator-controlled means including means for disconnecting said actuating means from said control means.

19. The machine of claim 17, wherein said operator-controlled means comprises a pedal.

* * * * *